US006184911B1

(12) United States Patent
Tombs

(10) Patent No.: US 6,184,911 B1
(45) Date of Patent: Feb. 6, 2001

(54) APPARATUS AND METHOD FOR RECORDING USING AN ELECTROGRAPHIC WRITER AND AN IMAGING WEB

(76) Inventor: Thomas N. Tombs, Eastman Kodak Company, 343 State St., Rochester, NY (US) 14650

( * ) Notice: Under 35 U.S.C. 154(b), the term of this patent shall be extended for 0 days.

(21) Appl. No.: 09/089,744

(22) Filed: Jun. 3, 1998

(51) Int. Cl.[7] ..... B41J 2/385
(52) U.S. Cl. ..... 347/117; 347/141; 347/158
(58) Field of Search ..... 347/115, 117, 347/140, 141, 151, 158

(56) References Cited

U.S. PATENT DOCUMENTS

| | | | | |
|---|---|---|---|---|
| 3,743,411 | * | 7/1973 | Krekow et al. | 347/141 |
| 4,118,710 | * | 10/1978 | Tomita et al. | 347/141 |
| 4,568,955 | * | 2/1986 | Hodoya et al. | 347/55 |
| 4,748,464 | * | 5/1988 | Pannekoek et al. | 347/141 |
| 5,483,269 | * | 1/1996 | Van Stiphout et al. | 347/55 |
| 5,793,401 | * | 8/1998 | Peter | 347/142 |

FOREIGN PATENT DOCUMENTS 2-130159 * 5/1990 (JP) .

OTHER PUBLICATIONS

Oce' Technology Info; Oce' Direct Imaging is a True Digital Technology; 1996.

Hard copy observer; Apr. 1996; pp. 27–32.

* cited by examiner

*Primary Examiner*—Joan Pendegrass

(57) ABSTRACT

An electrographic recording apparatus method includes a primary image forming member (PIFM) such as a web or drum that moves in a process direction. An electrographic writehead has a row of spaced electrodes arranged with the row being transverse of the process direction. The electrodes are selectively activated to establish respective electrical fields for recording of a respective row of pixels on the PIFM. The writehead faces a first surface of the PIFM and is positioned in contact with or closely adjacent the first surface to establish the respective electrical fields through the PIFM. A development station includes electrostatically charged toner particles in the form of a nap that selectively deposits the toner particles on a second surface of the PIFM directly opposite the series of spaced electrodes so that the toner particles are electrostatically selectively attracted by the respective electrical fields to develop the respective pixels to form a toner image on the second surface of the PIFM.

16 Claims, 3 Drawing Sheets

APPARATUS AND METHOD FOR RECORDING USING AN ELECTROGRAPHIC WRITER AND AN IMAGING WEB

BACKGROUND OF THE INVENTION

1. Field of the Invention

The invention relates to electrographic recording apparatus and methods wherein an electrographic writer establishes electrical fields that are used to selectively develop toner into an image.

2. Description Relative to the Prior Art

In the art of electrographic recording, it is well known to provide an electrographic writer or writehead that has a series of electrodes that can be selectively activated to selectively deposit charge and thereby record an electrostatic image on an insulative recording member. The electrostatic image is then advanced to a development station wherein the electrostatic image is developed to be visible by selectively attracting visible marking particles such as liquid or dry toner particles to deposit on the insulative recording member. The developed toner image is then transferred and fused to a receiver member such as plain paper or plastic to form a permanent record of the image.

A problem with electrographic recording on an insulative recording member using an ionographic recorder is that it is difficult to control position or placement of a charge pixel on the recording member and thus the recording images are not as well defined as in electrophotographic recording. Electrographic recording is distinguishable from electrophotographic recording in that the image is not required to be formed on a light sensitive member and light is not used in recording the image.

In order to improve upon electrographic recording there has recently been described by Oce Nederland B. V. a direct imaging electrographic writer that features a rotatable cylindrical writehead in the form of a drum. The drum has imbedded ring electrodes that are selectively provided with a voltage to attract toner in a development station. As the writer drum rotates, the voltages on the ring electrodes change in accordance with image data to form a toned image on the writehead. The toned image on the writehead is then transferred to a heated transfer roller and then simultaneously transferred to paper and fused.

A problem associated with development of toner images on the writehead itself is the buildup of contamination on the writehead which affects adversely the quality of the images formed thereon.

It is therefore an object of the invention to provide an improved electrographic apparatus and method that reduces the contamination problem and avoids the problem of having to place the electrostatic image well upstream of the development station and does not require use of an electrophotoconductive member.

SUMMARY OF THE INVENTION

The invention and its objects and advantages are achieved in accordance with a first aspect of the invention by an electrographic recording apparatus comprising a primary image forming member (PIFM) moving in a process direction; an electrographic writehead having a row of spaced electrodes arranged with the row being transverse of the process direction, the electrodes being selectively activated to establish respective electrical fields for recording of a respective row of pixels on the PIFM, the writehead facing a first surface of the PIFM and positioned in contact with or closely adjacent the first surface to establish the respective electrical fields through the PIFM; a development station including electrostatically charged toner particles in the form of a nap that selectively deposits the toner particles on a second surface of the PIFM directly opposite the series of spaced electrodes so that the toner particles are electrostatically selectively attracted by the respective electrical fields to develop the respective pixels to form a toner image on the second surface of the PIFM, the second surface being opposite the first surface; and wherein the PIFM moves relative to the writehead and the development station.

In accordance with a second aspect of the invention, there is provided an electrographic recording method comprising moving a primary image forming member (PIFM) in a process direction; providing an electrographic writehead having a row of spaced electrodes arranged with the row being transverse of the process direction, selectively activating the electrodes to establish respective electrical fields for recording of a respective row of pixels on the PIFM, the writehead facing a first surface of the PIFM and positioned in contact with or closely adjacent the first surface to establish the respective electrical fields through the PIFM; providing a development station including a nap of electrically charged toner particles; selectively depositing the particles on a second surface of the PIFM directly opposite the series of spaced electrodes by electrostatically selectively attracting the toner particles by the respective electrical fields to develop the respective pixels to form a toner image on a second surface of the PIFM, the second surface being opposite the first surface; and wherein the PIFM moves relative to the writehead and the development station.

In accordance with a third aspect of the invention, there is provided A color electrographic recording method comprising providing a plural number of color separation image forming modules, each module including a primary image forming member (PIFM), and an electrographic writehead and a development station; in each module forming a respective color separation image on the PIFM by operating the respective writer to establish selective recording electrical fields across a process direction while moving the PIFM in the process direction past a development station having a nap of electrically charged toner particles of the respective color, the nap being presented to one surface of the PIFM while the recording electrical fields are established through the PIFM with the writehead positioned adjacent a second surface of the PIFM and directly opposite the nap; and moving a receiver sheet into contact with a PIFM of each module to transfer respective color separation images in registration to form a multicolor image on the receiver sheet, wherein colors other than that of the respective toner particles are formed by superposition of toner particles of different colors.

BRIEF DESCRIPTION OF THE DRAWINGS

Further objects, advantages and feature of the invention in its various embodiments will become more apparent from the accompanying drawings and following detailed description of the invention wherein.

DETAILED DESCRIPTION OF THE PREFERRED EMBODIMENTS

Because electrographic reproduction apparatus are well known, the present description will be directed, in particular, to elements forming part of, or cooperating more directly with, the present invention. Apparatus not specifically shown or described herein are selectable from those known in the prior art.

Figure 1:
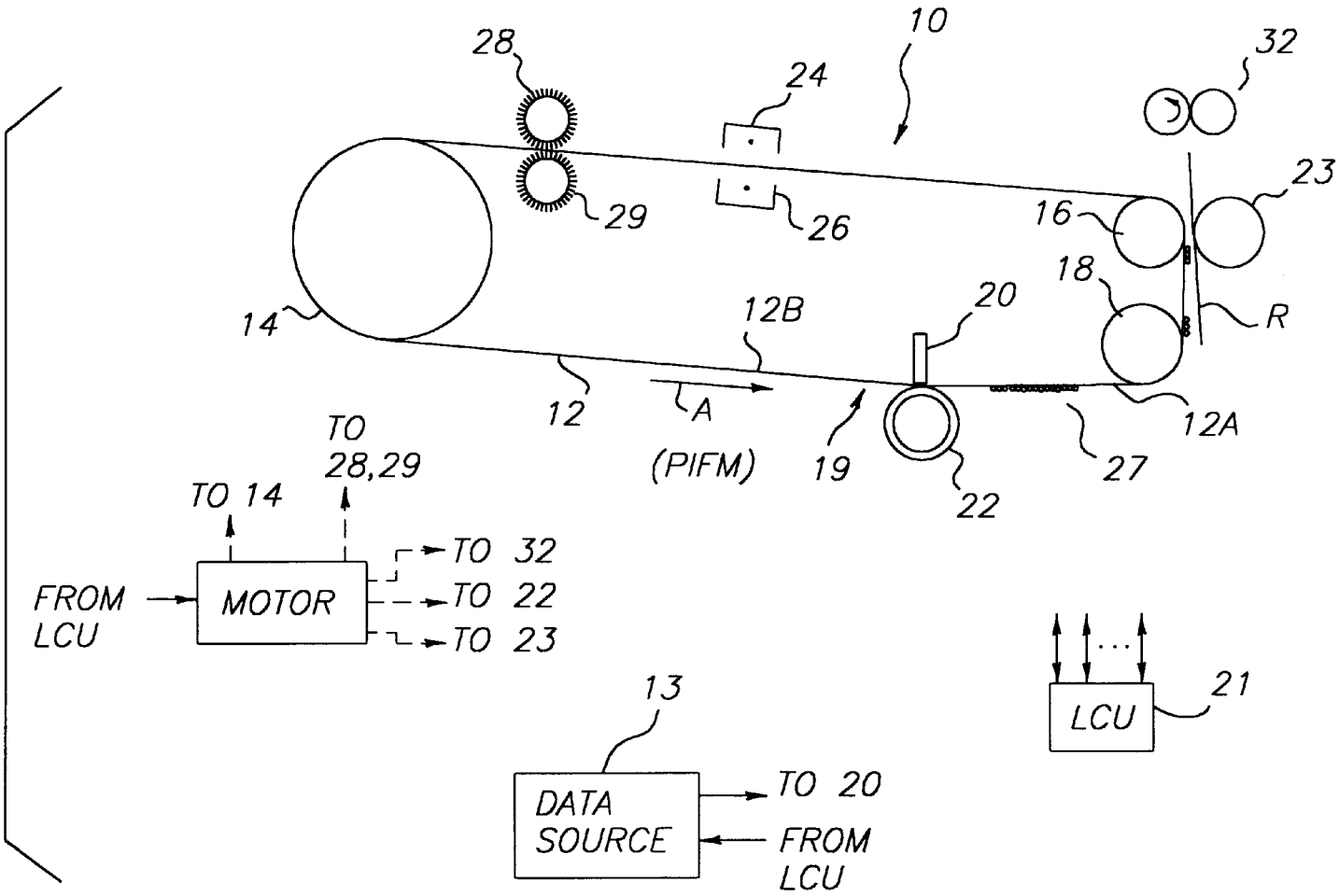
FIG. 1 is a schematic elevational view showing an electrographic printing apparatus incorporating the features of the present invention.

With reference to FIG. 1, an electrographic reproduction apparatus 10 includes a primary image-forming member (PIFM) such as a web 12 that is trained about three transport rollers 14, 16 and 18, thereby forming an endless or continuous web. The PIFM may also be a drum. Roller 14 is coupled to a drive motor M in a conventional manner which in turn is connected to a source of potential that when a switch (not shown) is closed by a logic and control unit (LCU) 21, the roller 14 is driven by the motor and moves the web 12 in a direction as indicated by arrow A. This movement causes a successive image area of the web 12 to sequentially pass direct write station 19 of the reproduction apparatus.

The LCU may have one or more microprocessors arranged to perform arithmetic and logic operations and instruction decoding for operation of the marking engine as well as controlling the time allocation of periperals such as a paper supply controller and accessories through a machine control communications link. Several output functions may be available for receiver sheets including selection of output trays, stapling, sorting, folding, finishing mailbox envelope receiver, etc. Programming of a number of commercially available microprocessors is a conventional skill well understood in the art. This disclosure is written to enable a programmer having ordinary skill in the art to produce an appropriate control program for the microprocessor(s). The particular details for any such program would of course, depend on the architecture of the designated microprocessor.

A data source 13 which may include a scanner, word processor, computer work station or data reader includes a memory for storing in digital form, for example a page of image data to be recorded on an image frame of the PIFM 12. Various sensors may be provided on the apparatus as is well known, to communicate information to the LCU so that various timing functions are appropriately timely enabled or deactivated as is well known in accordance with programmed control of apparatus of this type.

At the direct write station 19 digital image data from the data source 13 representing a line of pixels to be recorded is fed serially or parallel to data storage registers on the electrographic writehead 20. The writehead 20 comprises a series of electrodes that extends across the PIFM 12 in a row transverse to the direction of movement of the web 12.

The writehead has one or more rows of electrodes on its surface. Electrodes are approximately the width of a single pixel. A writehead having 600 dots per inch (dpi) addressability would have electrodes spaced about 42 $\mu$m apart. The shape of the electrodes is not limited and can be square, circular or in certain embodiments long and thin. The electrodes must be separated by an insulating gap or dielectric material so that they can maintain sufficient charge or voltage for the time needed to develop an image in the apparatus. The crosstrack length of the electrodes would thereby be smaller than the electrode spacing. For example, a 600 dpi writehead could have 10 $\mu$m between each electrode. With a spacing of 42 $\mu$m, that makes their cross-track length 32 $\mu$m. The intrack length of the electrodes is preferably about the same size as the cross-track length but could be much longer. For some embodiments, the in-track length could extend over the entire writer such as practiced by the Oce direct writer. The electrodes can be biased to various levels to develop pixels with a range of toner density thereby operating as a grayscale writer. Alternatively, the electrodes can operate in a binary mode to either record or not record a pixel.

The writehead can be in the form of a rotating drum or stationary drum or bar. When in the form of a stationary drum or bar, the row or rows of electrodes remain adjacent to or preferably in contact with the surface 12B of the PIFM as the PIFM travels over or near the electrodes. Adjacent the opposite surface 12A of the PIFM is the development or toning station 22. The toning station as can be seen in FIG. 1 is directly opposite the writehead and the bias on the electrodes of the writer are controlled so that the resulting electric field in the toning nap causes the toner to develop selectively on the PIFM as the PIFM travels past the writehead. The electrodes are controlled temporally and spatially so that toner develops on the imaging web only in image areas as dictated by the information sent to the writehead. For the rotating drum, contacts to the electrodes can be made from outside or inside the writehead. Ionographic writers may also be used and are broadly included herein as electrographic writers or writeheads. However, it is preferred that the electrographic writehead not generate ions and thus preference is to writeheads that contact the PIFM.

The developed toner image 27 on the PIFM is then transported to a transfer station wherein a receiver sheet R is fed in timed relationship with the image on the image frame of the PIFM into intimate contact therewith through a nip formed by transfer roller 23 and roller 16. In the nip, electrostatic transfer of the toner image is made to the receiver sheet. The transfer may be in the presence of heat to provide a thermal transfer. Preferably, the transfer is electrostatic by electrically biasing roller 23 to a polarity and potential suitable for attracting toner to the receiver sheet as is well known. Corona charger transfer may also be used. The receiver sheet with the transferred image is then detached from the PIFM and transported through fusing rollers 32 which fix the toner image to the receiver sheet. The receiver sheet is then transported to a bin for storage or inverted for duplexing by a mechanism not shown for transfer of a second image to a second side of the receiver sheet.

The PIFM is then neutralized of charge on both sides by corona charging stations 24, 26 and remnant toner or dirt is cleaned at a cleaning station which may include cleaning brushes 28, 29 or blades and is prepared for reuse.

The PIFM web 12 is endless and thin. The thickness of the PIFM is less than 200 $\mu$m and preferably between 5 $\mu$m and 200 $\mu$m and more preferably between about 10 $\mu$m and about 50 $\mu$m. While embodiments can be envisioned that utilize webs having resistive properties, it is preferred that the web is insulative; i.e., volume resistivity is greater than about $10^{12}$ ohm-cm. Examples of materials than can be used for imaging webs include polycarbonate (Lexan™), polyethylene terephthalate (Estar™), polyimide (Kapton™) and polyvinylidene fluoride, polyurethane, polyethylene napthoate.

The toning station can be single component or dual component. A dry, two-component developer such as SPD toning stations as found in commercial electrographic copiers by Eastman Kodak Company, Rochester, N.Y. represent the preferred toning stations. SPD toning stations create a toner nap formed by chains of carrier particles that carry tribo-electrically charged toner particles. The chains contact the surface to be developed and the toner particles selectively adhere to areas of the PIFM in accordance with the electrical field established by the electrodes of the writehead. A description of SPD toning or development stations is provided in I S&T's Sixth International Congress on Advances in Non-Impact Printing Technologies by Edward T. Miskinis, pages 101–110. The image can be transferred to paper and subsequently fused by various means well known in the electrophotographic industry.

A major advantage of this technology is that the writer does not come in contact with toner or developer and therefore does not depend on the stringent cleaning requirements needed for standard electrographic devices of this type. A second important advantage is that the writer can be made significantly smaller and thus considerably less expensive than similar devices that require a cleaning, toning and transfer station positioned adjacent to the electrode covered write drum.

Figure 2:
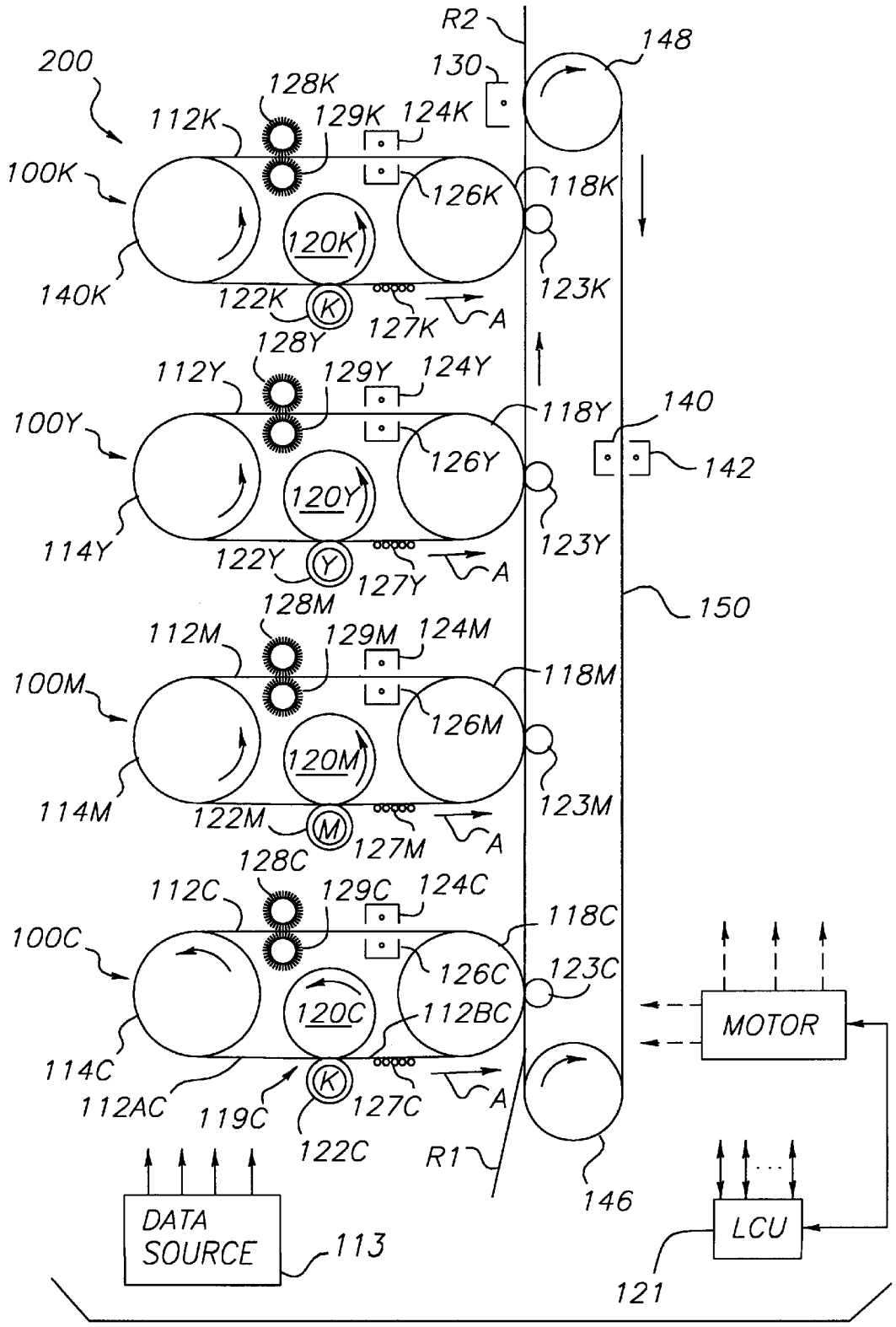
FIG. 2 is a schematic elevational view showing a multicolor electrographic printing apparatus incorporating the features of the present invention.

With reference to FIG. 2, there is a second embodiment of the invention in the form of an apparatus 200 that has four direct writer stations to provide four color reproductions. The apparatus includes four direct write modules 100C, 100M, 100Y and 100K for forming toner images in cyan, magenta, yellow and black, respectively. The modules are substantially identical but for the color of toner in the development stations and the various voltage potentials that are suited for development of each of the toner images. In view of the similarity of the modules, description will be made with regard to one of the modules, it being understood that such description is also applicable to the other modules. Considering direct writer station module 100C for forming cyan color separation images, an endless PIFM web or belt 112C is trained for movement about two rollers 114C, 118C, one of which may be driven or receive drive from a receiver sheet transport web 150. A direct write station 119C is comprised of a drum type electrographic writer 120C which engages or is located proximate one surface 112BC of web 112C. Web 112C is similar to that of the PIFM of FIG. 1. The writer 120C can be similar to the known rotating drum writer described above and may include a series of rings formed in a drum, the rings being formed at a spacing of 1/400 inches and, more preferably, 1/600 inches or may have rows of electrodes over the majority of the surface of the drum writer. The drum of writehead 120C has data registers that store one, and preferably two, lines of digital image data so that as one line is being printed, the second line is being input into the data registers and assembled so as to be ready for forming the next row or line of pixels. The drum of writehead 120C extends transverse, preferably perpendicular to the direction of movement of the PIFM that is indicated by arrow A. As the web 112C moves, the writehead 120C rotates and in response to the next line of image data, voltages are selectively created on the rings to change the electrical field generated by each ring so as to record the next line of pixels. The recording of pixels is made by selective deposition of toner particles from development station 122C in response to the respective electrical fields established by the writehead 120C. The toner image 127C deposits on an image frame of surface 112AC of PIFM 112C which surface faces the development station 122C. As in the embodiment of FIG. 1, the writehead 120C and the development station 122C are directly opposed with the PIFM 1112C moving between them so that the contamination of the writehead 120C by toner is minimized.

When the writer is in the form of rotating drum electrodes cover a majority of the surface. The drum 120C rotates at the same surface speed as the imaging web. As the electrodes on the drum 120C travel past the toning station, toner develops on the PIFM or imaging web 112C corresponding to the bias on the electrodes. Because the PIFM 112C is separate from the writehead 120C and moves relative to the development station 122C and the writehead 120C the toned image is carried away on the PIFM surface 112AC for transfer to a receiver sheet.

After the image is developed with visible toner or marking particles the toned image 127C is brought to a transfer station that includes a transfer nip formed by a transfer backing roller 123C and roller 118C. A receiver sheet R1 is brought into the nip conveyed by a transfer support belt 150 and in timed correspondence with movement into the nip of the image frame having the cyan color separation image 127C. A voltage bias is provided on transfer roller 123C of suitable amount and polarity to transfer the cyan image to the receiver sheet R1. The receiver sheet moves along the belt 150 into respective nips formed by rollers 118M, 123M; 118Y, 123Y; 118K, 123K to transfer respectively to the receiver sheet the magenta color separation toner image 127M, the yellow color separation toner image 127Y and the black color separation toner image 127K in registration so that a multicolored image is formed on the receiver sheet. An advantage to this arrangement is that the toned color images may be transferred to the receiver sheet in superposed stacked relationship so that one or more colors are directly overlying or superposed to create different color combinations with improved saturation. The receiver sheet is then passed beneath a detack charger 130 which charges the receiver sheet to reduce attraction of the receiver sheet to the transfer support belt 150. The endless belt 150 is then conveyed past corona chargers 140, 142 to neutralize any charge on the belt. A receiver sheet (R2) with one or a multicolored image, in accordance with the required image to be formed, is then passed to a fusing station (not shown) to have (for example) the multicolor toner image fixed thereto and may be circulated back for recording an image on a second side or it may be transported to a bin or output location. The endless belt 150 is preferably relatively insulative with a volume resistivity greater than $10^{12}$ ohm-cm. The belt 150 is trained about rollers 146 and 148 one of which may be driven by motor M, and also trained about transfer backing rollers 123C, M, Y and K so that the belt 150 passes through each transfer nip. In this regard, reference may also be made to published international application WO 98/04961 for details of transfer systems which use a transport support belt.

After transfer of a toner image to the receiver sheet, each PIFM is then neutralized of charge on both sides by corona charging stations 124C, 126C (for the cyan write module) and remnant toner or dirt is cleaned at a cleaning station which may include cleaning brushes 128C, 129C or blades and is prepared for reuse.

Figure 3:
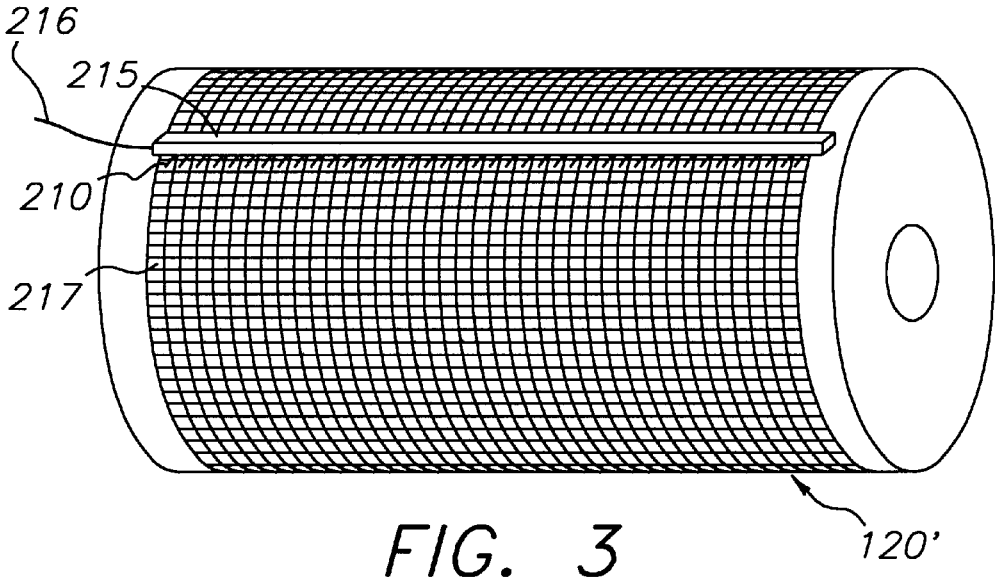
FIG. 3 is an illustration of a rotatable electrographic writehead drum having electrodes external to the drum for imagewise electrically biasing the drum.

A logic and control unit 121 controls synchronization of recording of the images by the modules and sequential transfer of the images in registration in accordance with signals from sensors associated with the various components as is well known. A data source 113 provides respective color separation image data to each of the writeheads.

Where a rotating drum writehead is used, the drum may be of either a type wherein electrical biasing of the writehead is provided by external or internal contacts. FIG. 3 illustrates a writehead drum 120' whose surface is provided with small conductive islands 217 that are insulated from each other so that each island represents a pixel size electrode area with 600 electrode areas to the inch in the axial direction. A series of contacts 210 on a contact bar 215 are uniformly spaced axially across the writedrum and respectively engage the writedrum surface at intervals of 1/600 inches. Circuitry on the contact bar distributes proper electrical biasing to each respective contact in accordance with image data input to the bar via input line 216. Thus, an axial row of charged (electrographic) recording pixels is simultaneously applied to the writehead drum. As the drum 120' rotates, additional rows of electrographic or charged pixels are placed on the drum at increments of, for example, 1/600 inches between rows. The imagewise charged drum then rotates into the nip with the PIFM and the opposed development station and a corresponding visible toner image is recorded on the PIFM. In lieu of the writehead drum being formed with conductive islands, it may instead be insulating.

Figure 4:
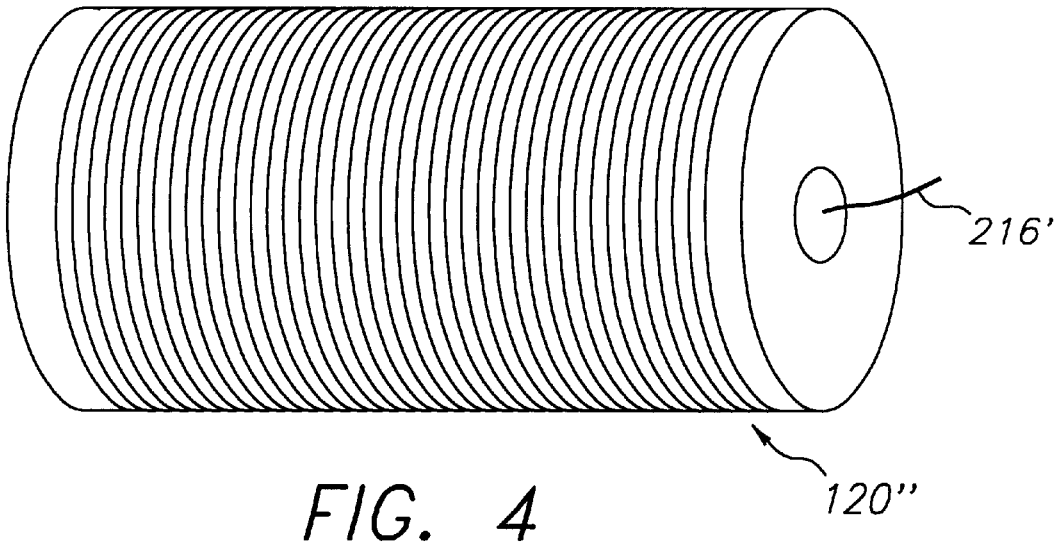
FIG. 4 is an illustration of a rotatable electrographic writehead drum having electrodes internal to the drum for imagewise electrically biasing the drum.

FIG. 4 illustrates an example of a rotatable writehead drum 120" that features internal biasing of the electrodes. The surface of the drum 120" or a layer very near the surface includes a series of electrode rings that are axially spaced, for example, 1/600 inches apart. Electrical circuitry is provided within the drum for simultaneously enabling each ring with an electrical bias corresponding to a respective pixel to be recorded along a row of the PIFM. The bias is applied while the writedrum engages and rotates with the PIFM. A development station opposite the writehead, as described above, records the corresponding row of pixels with toner.

There has thus been described a novel electrographic apparatus that images directly on to an endless web. The web runs between an electrographic or ionographic writehead and a toning station. The writehead comprises a drum or bar having one or more rows of small electrodes approximately the width of individual pixels. Charge or voltage (bias) applied to the writehead's electrodes develops toner on the imaging web or PIFM as it passes between the writehead and the toning station. When the latent image travels past the toning station with the imaging web between the writehead and the toning station, a toned image develops on the imaging web. The toning station provides a cloud-like, nap or non-image specific environment of toner on a first surface of the PIFM. On the opposite or second surface of the PIFM, the electrical field is imagewise specifically controlled to selectively attract toner to deposit on the first surface.

The invention has been described in detail with particular reference to certain preferred embodiments thereof, but it will be understood that variations and modifications can be effected within the spirit and scope of the invention.

What is claimed is:

1. An electrographic recording apparatus comprising:

a primary image forming member (PIFM) moving in a process direction;

a rotatable electrographic writehead having plural rows of spaced electrodes, each respective row of spaced electrodes being rotated, in turn, so as to be positioned transverse of the process direction, and opposite a development nap, the electrodes of a respective row being selectively activatable to establish respective electrical fields for recording of a respective row of pixels on the PIFM, the writehead facing a first surface of the PIFM and positioned in contact with or closely adjacent the first surface to establish, when a respective row is activated, the respective electrical fields through the PIFM;

a development station including electrostatically charged toner particles in the form of the nap that selectively deposits the toner particles on a second surface of the PIFM directly opposite the series of spaced electrodes so that the toner particles are electrostatically selectively attracted by the respective electrical fields to develop the respective pixels to form a toner image on the second surface of the PIFM, the second surface being opposite the first surface; and wherein the PIFM moves relative to the writehead.

2. The apparatus of claim 1 and including a transfer station for transferring the toner image to a receiver member.

3. The apparatus of claim 2 and including plural of said writeheads, plural of said primary image forming members, plural development stations and plural transfer stations each having a respective transfer nip and wherein each of said writeheads faces one surface of a respective PIFM and is positioned in contact with or closely adjacent the one surface of the respective PIFM and each of said development stations is positioned directly opposite a respective one of said writers with a respective PIFM located between a respective PIFM and one of said development stations, wherein each PIFM is movable relative to a respective writehead to advance a respective toner image formed on the PIFM to a respective transfer nip for transfer of the toner image to a receiver member.

4. The apparatus of claim 3 wherein each PIFM is a web and each transfer station includes a receiver member transport web that forms plural transfer nips with the plural PIFMs to serially transfer respective toner images on the PIFM to the receiver member as the receiver member is moved by the transfer web.

5. The apparatus of claim 3 wherein the PIFM is a web.

6. The apparatus of claim 1 wherein the PIFM is a web.

7. The apparatus of claim 6 wherein the PIFM has a thickness of less than 200 $\mu$m.

8. The apparatus of claim 6 wherein the PIFM has a thickness of between about 10 $\mu$m and about 50 $\mu$m.

9. The apparatus of claim 1 wherein the electrodes are biased from contacts outside the surface of the writehead.

10. The apparatus of claim 1 wherein the writehead is in the form of a rotatable drum and the electrodes cover a majority of the surface of the drum.

11. The apparatus of claim 10 wherein the electrodes are biased from inside the drum.

12. An electrographic recording method comprising:

moving a primary image forming member (PIFM) in a process direction;

rotating an electrographic writehead having plural rows of spaced electrodes, each respective row of spaced electrodes being rotated, in turn, so as to be positioned transverse of the process direction and opposite a development nap, selectively activating the selected electrodes in a respective row to establish respective electrical fields for recording of a respective row of pixels on the PIFM, the writehead facing a first surface of the PIFM and positioned in contact with or closely adjacent the first surface to establish the respective electrical fields through the PIFM;

providing a development station including the nap of electrically charged toner particles;

selectively depositing the particles on a second surface of the PIFM directly opposite the series of spaced electrodes by electrostatically selectively attracting the toner particles by the respective electrical fields to develop the respective pixels to form a toner image on a second surface of the PIFM, the second surface being opposite the first surface; and wherein the PIFM moves relative to the writehead.

13. The method of claim 12 and including transferring the toner image to a receiver member.

14. The method of claim 13 wherein the PIFM is a web.

15. The method of claim 12 wherein the PIFM is a web.

16. A color electrographic recording method comprising:

providing a plural number of color separation image forming modules, each module including a primary image forming member (PIFM) and a rotatable electrographic writehead and a development station;

in each module forming a respective color separation image on the PIFM by operating the respective writer to establish selective recording electrical fields across a process direction while moving the PIFM in the process direction past a development station having a nap of electrically charged toner particles of the respective color, the nap being presented to one surface of the PIFM while the recording electrical fields are established through the PIFM with the writehead rotating so as to selectively position respective rows of electrodes adjacent a second surface of the PIFM and directly opposite the nap; and moving a receiver sheet into contact with a PIFM of each module to transfer respective color separation images in registration to form a multicolor image on the receiver sheet, wherein colors other than that of the respective toner particles are formed by superposition of toner particles of different colors.

* * * * *